US008479668B2

(12) United States Patent
Li et al.

(10) Patent No.: US 8,479,668 B2
(45) Date of Patent: Jul. 9, 2013

(54) LOW NOX SWIRL COAL COMBUSTION BURNER

(75) Inventors: Zhengqi Li, Nangang District Harbin (CN); Zhichao Chen, Nangang District Harbin (CN); Rui Sun, Nangang District Harbin (CN); Shaozeng Sun, Nangang District Harbin (CN); Shaohua Wu, Nangang District Harbin (CN); Ming Qin, Nangang District Harbin (CN); Hui Liu, Nangang District Harbin (CN); Yunkun Qin, Nangang District Harbin (CN)

(73) Assignee: Harbin Institute of Technology, Harbin (CN)

( * ) Notice: Subject to any disclaimer, the term of this patent is extended or adjusted under 35 U.S.C. 154(b) by 1164 days.

(21) Appl. No.: 12/227,473

(22) PCT Filed: Jul. 18, 2007

(86) PCT No.: PCT/CN2007/070317

§ 371 (c)(1),
(2), (4) Date: Nov. 17, 2008

(87) PCT Pub. No.: WO2009/009945

PCT Pub. Date: Jan. 22, 2009

(65) Prior Publication Data

US 2010/0018445 A1 Jan. 28, 2010

(51) Int. Cl.
*F23D 1/00* (2006.01)
*F23K 3/02* (2006.01)

(52) U.S. Cl.
USPC ..... 110/104 B; 110/261; 110/264

(58) Field of Classification Search
USPC ..... 110/104 B, 260, 261, 262, 263, 264, 110/265
See application file for complete search history.

(56) References Cited

U.S. PATENT DOCUMENTS

| | | | | | |
|---|---|---|---|---|---|
| 1,510,645 | A | * | 10/1924 | Bergman | 110/104 B |
| 4,412,496 | A | * | 11/1983 | Trozzi | 110/263 |
| 4,428,309 | A | * | 1/1984 | Chang | 110/262 |
| 4,545,307 | A | * | 10/1985 | Morita et al. | 110/264 |
| 5,415,114 | A | * | 5/1995 | Monro et al. | 110/347 |
| 5,937,770 | A | * | 8/1999 | Kobayashi et al. | 110/263 |
| 5,979,342 | A | * | 11/1999 | Leisse et al. | 110/264 |
| 6,807,914 | B2 | * | 10/2004 | Leisse et al. | 110/106 |

FOREIGN PATENT DOCUMENTS

JP 01217110 A * 8/1989

* cited by examiner

*Primary Examiner* — Kenneth Rinehart
*Assistant Examiner* — David J Laux
(74) *Attorney, Agent, or Firm* — Raymond Y. Chan; David and Raymond Patent Firm

(57) ABSTRACT

A burner includes a primary air-coal mixture duct coaxially extended through a secondary air wind box, a pulverized coal separator supported within the primary air-coal mixture duct, a secondary air duct including an inner secondary air duct and an outer secondary air duct coaxially formed around the primary air-coal mixture duct, a primary air-coal mixture conical outlet coupled with the outlet of the primary air-coal mixture duct, and inner secondary air and outer conical outlets coupled with the outlets of the inner secondary air and outer secondary air ducts respectively. The conical outlets are arranged to delay the mixing time of the primary air-coal mixture and secondary air flows through the primary air-coal mixture and secondary air ducts and to prolong the residence time in the center recirculation zone under the reduction ability so as to effectively reduce the formation of NOx.

2 Claims, 4 Drawing Sheets

LOW NOX SWIRL COAL COMBUSTION BURNER

BACKGROUND OF THE PRESENT INVENTION

1. Field of Invention

The present invention relates to a burner, and more specifically to a centrally fuel rich (CFR) swirl coal combustion burner which can reduce the output of the emissions amount of NOx.

2. Description of Related Arts

Nitrogen Oxide (NOx) is one of the main contaminants for air pollution. It not only forms the acid rain to damage the ecological environment, but also forms the actinic fog to harm the health of human being. The coal combustion is one of the main sources of the generation of nitrogen oxide compound. At the present, there are two methods to control the formation of NOx. The first method is low NOx combustion technology which can reduce the formation of NOx. The second method is the flue gas denitrification which applies removing reactant of denitrification to the flue gas to remove NOx. China Patent, CN1207511C, publication date of Jun. 22, 2005, entitled "Centrally Fuel Rich (CFR) Swirl Coal Combustion burner", teaches the control of the formation of NOx, as the first method, to control the formation of NOx. Accordingly, the burner comprises a pulverized separator having a cone shape to collect the pulverized coal at the central portion of a primary air-coal mixture duct, wherein the injection of the pulverized coal is aligned with a center of the central recirculation zone of the burner. Throughout the combustion of the pulverized coal, the concentration of the pulverized coal is increased within the central recirculation zone while the residence time of pulverized coal is prolonged to reduce the formation of NOx. However, there is no conical outlet installed at the outlets of the primary air-coal mixture, inner and outer secondary air ducts, the pulverized coal at the primary air-coal mixture and inner and outer secondary air ducts is parallelly spurted into the furnace so that the central recirculation zone formed by the swirl of the secondary air is relatively small. Thus, the residence time of pulverized coal in the central recirculation is not long enough to inhibit the formation of nitrogen oxide compound at most. Also, without the conical outlet, the air through the primary air-coal mixture and secondary air ducts is mixed immediately into the furnace, so that the ability of NOx reduction is substantially decreased. Therefore, it cannot effectively inhibit the formation of NOx. Furthermore, the major drawbacks of the second method of controlling the nitrogen oxide compound, through the flue gas denitrification by applying removing reactant of denitrification to flue gas to remove nitrogen oxide compound, are high investment cost and operating cost.

SUMMARY OF THE PRESENT INVENTION

A main object of the present invention is to provide a low NOx swirl coal combustion burner, which can solve the problem of the conventional CFR swirl coal combustion burner being ineffectively inhibited the formation of fuel-NOx.

Accordingly, in order to accomplish the above objects, the present invention provides a low NOx swirl coal combustion burner comprises a primary air-coal mixture duct, a conical pulverized coal separator, a secondary air wind box, and an inner secondary air vane, wherein the primary air-coal mixture duct is coaxially extended through the secondary air wind box. The pulverized coal separator is supported within the primary air-coal mixture duct, wherein an outlet of the pulverized coal separator, having a smaller diameter, is alignedly pointing towards an outlet of the of primary air-coal mixture duct. Inner and outer tubular sleeves are encirclingly coupled with the primary air-coal mixture duct to form an inner secondary air duct and an outer secondary air duct within the secondary air wind box. The present invention further comprises a primary air-coal mixture conical outlet, an inner secondary air conical outlet, and an outer secondary air conical outlet. The opening of the primary air-coal mixture conical outlet, with a smaller diameter, is coupled with the outlet of the primary air-coal mixture duct. The opening of the inner secondary air conical outlet, with a smaller diameter, is coupled with the outlet of the inner secondary air duct. The opening of the outer secondary air conical outlet, with a smaller diameter, is coupled with the outlet of the outer secondary air duct.

Accordingly, the present invention achieves the following advantages.

The secondary air flow is partitioned into two portions into the furnace through the inner and outer secondary air ducts, wherein the inner and outer secondary air vanes are arranged to regulate the two portions of the secondary air flow in a swirling manner at the inner secondary air duct and the outer secondary air duct respectively. Under the effects of the primary air-coal mixture conical outlet, the inner secondary air conical outlet, and the outer secondary air conical outlet, the flow of air-coal mixture at the primary air-coal mixture duct is mixed with the swirling air flow at the inner and outer secondary air ducts to form a moderate central recirculation zone. In addition, the burner of the present invention does not include any central duct. The primary air-coal mixture duct is located at a center of the burner, wherein the primary air-coal mixture flow is formed in a non-swirling manner that the primary air-coal mixture flow is straight-forwardly passing through the primary air-coal mixture duct. One or more pulverized coal separators are coaxially supported within the primary air-coal mixture duct along the centerline thereof to inject the flow of air-coal mixture at the center of primary air-coal mixture duct into the furnace, so as to increase the amount of the pulverized coal at the central recirculation zone, to enhance the reduction ability of the air-coal mixture at the central recirculation zone, and to prolong the residence time of the air-coal mixture at the center recirculation zone for effectively reducing the formation of NOx. The conical outlets are arranged to delay the mixing time of the primary air-coal mixture and secondary air flows through the primary air-coal mixture and inner and outer secondary air ducts and to further prolong the residence time in the center recirculation zone under the reduction ability so as to effectively reduce the formation of NOx. Accordingly, the secondary air flow is partitioned into two portions for being transversely injected into the furnace. The inner portion of the secondary air flow is used as an igniter for igniting the pulverized coal. The outer portion of the secondary air flow is used as an oxygen suppler for supplying enough oxygen for complete combustion of the pulverized coal, so as to inhibit the formation of NOx. The staged mixing manner of the secondary air flow at the radial direction has an advantage of reducing the emission of NOx.

These and other objectives, features, and advantages of the present invention will become apparent from the following detailed description, the accompanying drawings, and the appended claims.

DETAILED DESCRIPTION OF THE PREFERRED EMBODIMENT

Figure 1:
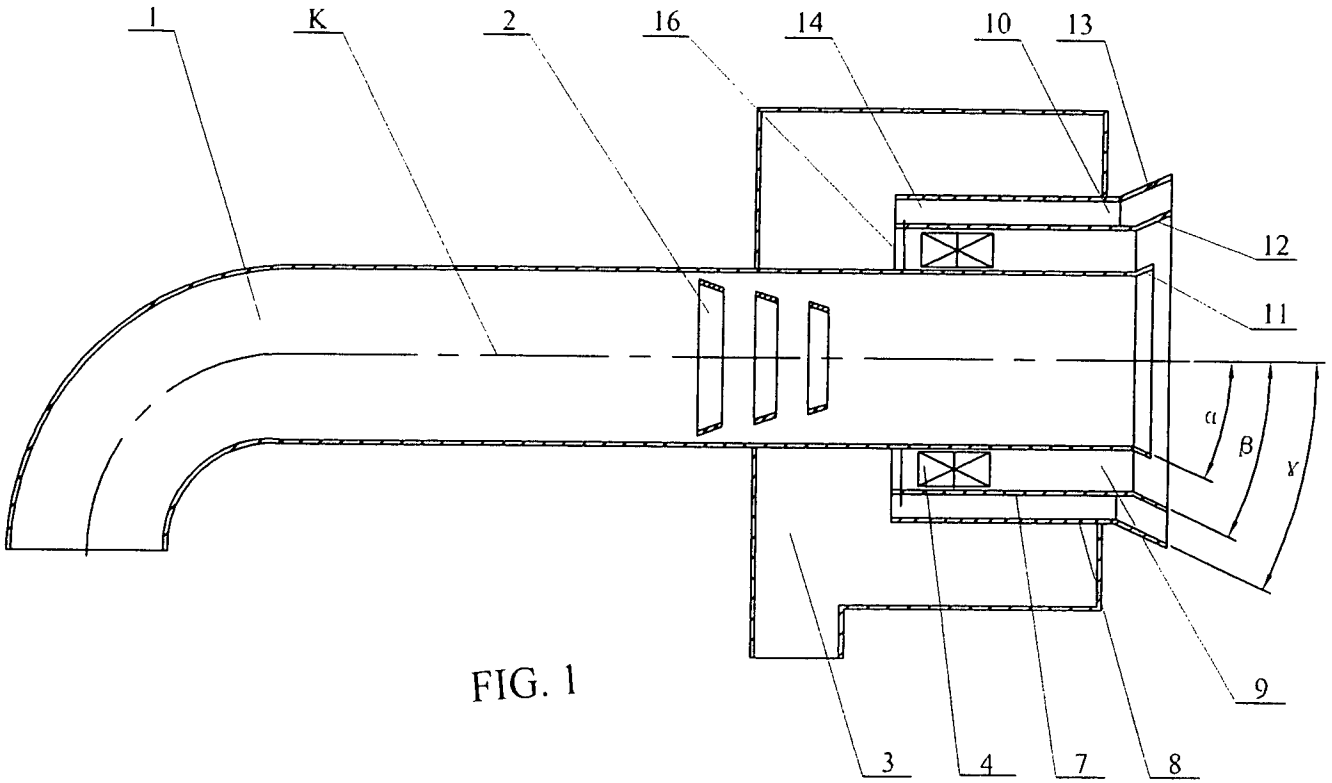
FIG. 1 is a sectional view of a low NOx swirl coal combustion burner according to a preferred embodiment of the present invention, wherein an outer secondary air vane is omitted.
Figure 2:
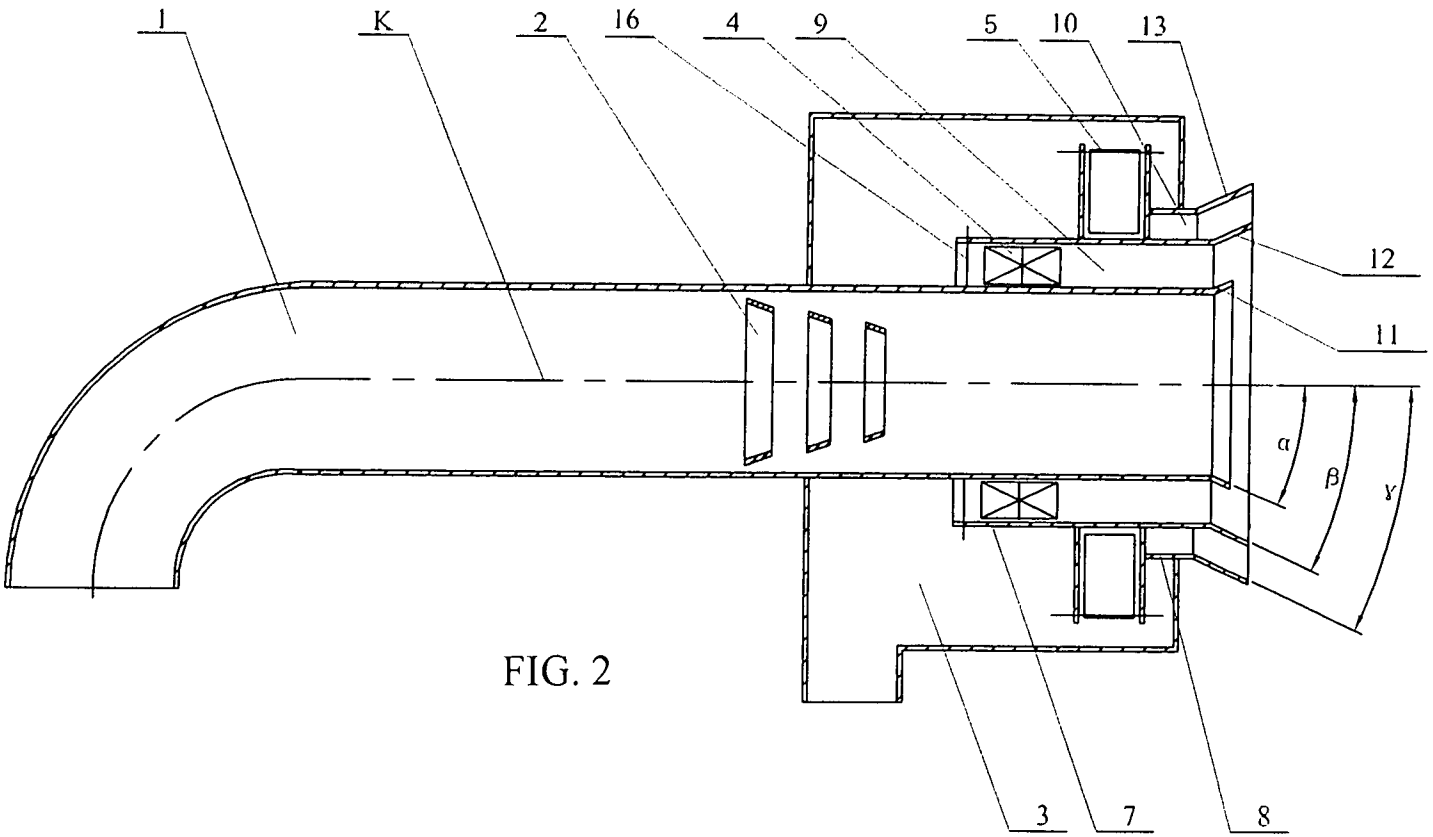
FIG. 2 is the sectional view of the low NOx swirl coal combustion burner according to the above preferred embodiment of the present invention, illustrating the outer secondary air vane being installed.

Referring to FIGS. 1 and 2 of the drawings, a low NOx swirl coal combustion burner according to a preferred embodiment of the present invention is illustrated, wherein the low NOx swirl coal combustion burner comprises a primary air-coal mixture duct 1, a conical pulverized coal separator 2, a secondary air wind box 3, an inner secondary air vane 4, a primary air-coal mixture conical outlet 11, an inner secondary air conical outlet 12, and an outer secondary air conical outlet 13.

The primary air-coal mixture duct 1 is coaxially extended through the secondary air wind box 3, wherein the pulverized coal separator 2 is supported within the primary air-coal mixture duct 1. An outlet of the pulverized coal separator 2, which is an opening having a smaller diameter, is alignedly pointing towards an outlet of the primary air-coal mixture duct 1. Inner and outer tubular sleeves 7, 8 are encirclingly coupled with the primary air-coal mixture duct 1 to form an inner secondary air duct 9 and an outer secondary air duct 10 within the secondary air wind box 3. The inner secondary air vane 4 is supported within the inner secondary air duct 9. The opening of the primary air-coal mixture conical outlet 11, with a smaller diameter, is coupled with the outlet of the primary air-coal mixture duct 1. The opening of the inner secondary air conical outlet 12, with a smaller diameter, is coupled with an outlet of the inner secondary air duct 9. The opening of the outer secondary air conical outlet 13, with a smaller diameter, is coupled with an outlet of the outer secondary air duct 10.

As shown in FIGS. 1 and 2, a set of pulverized coal separators 2 is spacedly supported within primary air-coal mixture duct 1. In particularly, the pulverized coal separators 2 are coaxially supported within the primary air-coal mixture duct 1 along the centerline K. The diameter of each of the pulverized coal separators 2 is gradually reducing towards the outlet of the primary air-coal mixture duct 1 while the diameters of the pulverized coal separators 2 are sequentially reducing towards the outlet of the primary air-coal mixture duct 1. Therefore, when the flow of the pulverized coal passes through the pulverized coal separators 2 along the primary air-coal mixture duct 1, a high-dense pulverized coal region is formed at the central portion of the primary air-coal mixture duct 1 while a less-dense pulverized coal region is formed near the inner wall of the primary air-coal mixture duct.

As shown in FIGS. 1 and 2, the inner secondary air duct 9 and the outer secondary air duct 10 are coaxially formed with respect to the primary air-coal mixture duct 1 such that the inner secondary air duct 9, an outer secondary air duct 10, and the primary air-coal mixture duct 1 share a common axis. Accordingly, the coaxial configuration of the primary air-coal mixture duct 1, the inner secondary air duct 9 and the outer secondary air duct 10 enhances the circulation of the primary air-coal mixture and secondary air flows passing therethrough.

As shown in FIGS. 1 and 2, the primary air-coal mixture conical outlet 11 is extended inclinedly at an angle $\alpha$ with respect to the centerline K of the primary air-coal mixture duct 1. The inner secondary air conical outlet 12 is extended inclinedly at an angle $\beta$ with respect to the centerline K of the primary air-coal mixture duct 1. The outer secondary air conical outlet 13 is extended inclinedly at an angle $\gamma$ with respect to the centerline K of the primary air-coal mixture duct 1. Accordingly, the angles $\alpha$, $\beta$, $\gamma$ are the same, wherein each of the angles $\alpha$, $\beta$, $\gamma$ has a threshold between 15° to 35°. It is worth to mention that if the angles $\alpha$, $\beta$, $\gamma$ are larger than the threshold, the air divergent angle will be substantially increased to form an open airflow. Therefore, pulverized coal will flow near to the water-cooling wall region so as to cause the deterioration of combustion and the slagging at the water-cooling wall. If the angles $\alpha$, $\beta$, $\gamma$ are smaller than the threshold, the primary air-coal mixture conical outlet 11, the inner secondary air conical outlet 12, and the outer secondary air conical outlet 13 will take no effect as the structure without the conical outlet 11, the inner secondary air conical outlet 12, and the outer secondary air conical outlet 13. In other words, the smaller angles $\alpha$, $\beta$, $\gamma$ will incapable of forming a moderate central recirculation zone and keeping a stable flame. Therefore, the angles $\alpha$, $\beta$, $\gamma$ of the conical outlets 11, 12, 13 are set within the threshold will have great influence on stabilizing the combustion and forming the moderate central recirculation zone to reduce the emission amount of NOx.

Figure 3:
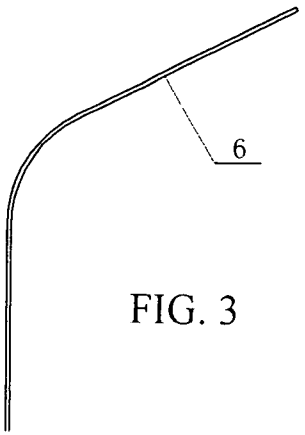
FIG. 3 is a sectional view of a curved vane blade of the low NOx swirl coal combustion burner according to the above preferred embodiment of the present invention.
Figure 4:
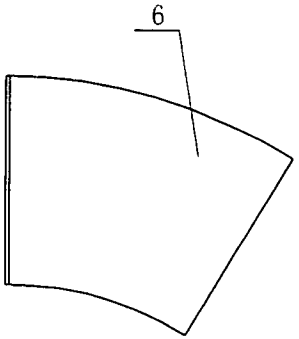
FIG. 4 is a top view of the curved vane blade the low NOx swirl coal combustion burner according to the above preferred embodiment of the present invention.
Figure 6:
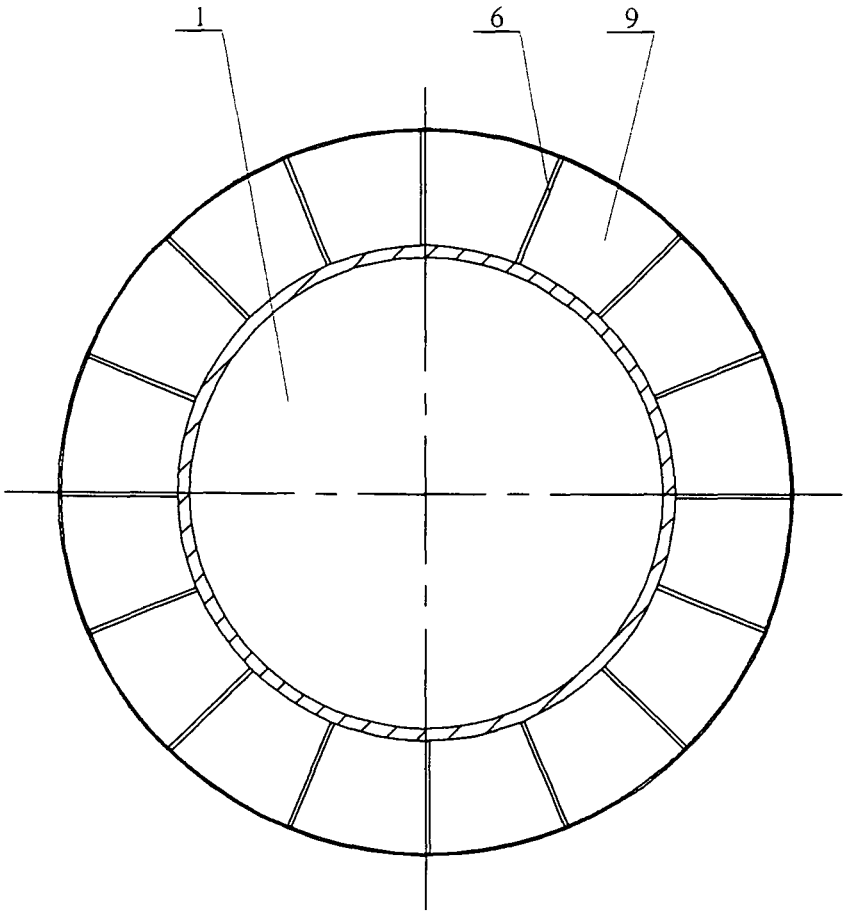
FIG. 6 is a sectional view of the inner secondary air vane welded on the wall of the primary air-coal mixture duct of the low NOx swirl coal combustion burner according to the above preferred embodiment of the present invention.

As shown in FIGS. 3, 4, and 6, the inner secondary air vane 4 comprises a set of curved vane blades 6, wherein each of the curved vane blades 6 has a curved configuration. Accordingly, the curved vane blades 6 are evenly, radially, and outwardly extended from the outer circumferential wall of the primary air-coal mixture duct 1 within the inner secondary air duct 9. In particularly, the corresponding edge of each of the curved vane blades 6 is securely affixed to the outer circumferential wall of the primary air-coal mixture duct 1. Accordingly, the structural configuration of the inner secondary air vane 4 has a simple structure and is adapted to distribute uniform air flow.

As shown in FIGS. 1 and 2, the burner of the present invention further comprises an inner secondary air damper 16 supported at an inlet of the inner secondary air duct 9, wherein the opening valve of the inner secondary air damper 16 is selectively adjusted to adjustably control the amount of air flow passing through the inner secondary air duct 9 and the outer secondary air duct 10. Accordingly, the air flow is guided to pass through the inner secondary air duct 9 in a swirling manner while the air flow is guided to straightforwardly pass through the outer secondary air duct 10 in a non-swirling manner. By selectively regulating the flow ratio of the air flow between the inner secondary air duct 9 and the outer secondary air duct 10 to adjust the swirl intensity of the air flow, the magnitude of the central recirculation zone is adapted to be adjustably controlled.

Figure 5:
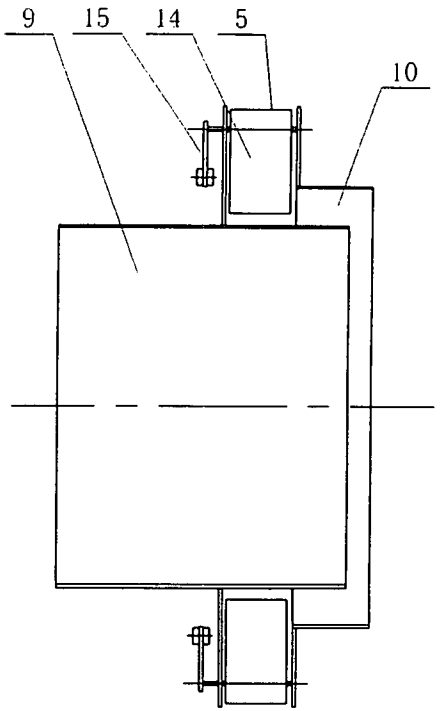
FIG. 5 is a sectional view of an outer secondary air vane according to the above preferred embodiment of the present invention, illustrating the structural relationship between the outer secondary air vane and the outer secondary air duct.

As shown in FIGS. 1, 2, and 5, the burner of the present invention further comprises an outer secondary air vane 5 supported at an inlet of the outer secondary air duct 10 to regulate the air flow passing through the outer secondary air duct 10 in a swirling manner. Therefore, the air flow is guided to pass through the inner secondary air duct 9 and the outer secondary air duct 10 in a swirling manner. Accordingly, the swirl intensity of the air flow is selectively adjusted by either selectively adjusting a regulating angle of the outer secondary air vane 5 or selectively adjusting a position of the outer secondary air vane 5 within the outer secondary air duct 10, so as to adjustably control the magnitude of the central recirculation zone.

As shown in FIGS. 2 and 5, the outer secondary air vane 5 comprises a set of flat vane blades 14 and a regulator 15 to selectively adjust the regulating angle of each of the flat vane blades 14. Accordingly, each of the flat vane blades 14 has a straight planar configuration. Each of the flat vane blades 14 is coupled at the inlet wall of the outer secondary air duct 10 via the regulator 15. Accordingly, the structural configuration of the outer secondary air vane 5 has a simple structure and is easy to adjust the swirl intensity of the air flow at the outer secondary air duct 10.

According to the preferred embodiment, the burner of the present invention is incorporated with a 1025 ton per hour B&WB-1025/18.3-M type boiler made by Babcock & Wilcox Beijing Co. Ltd, as an example. The combustion condition is shown as: lean coal as the pulverized coal, $V_{daf}$=21.35%; $A_{ar}$=29.42%; $M_t$=7.1%; and $Q_{net,ar}$=23162 kJ/kg, wherein $V_{daf}$ is the volatile matter as dry ash free, $A_{ar}$ is ash as received, $M_t$ is the moisture as received, and $Q_{net,ar}$ is the net heating value as received. By using 8 burners of the present invention at the bottom row of burners on the boiler, the amount of NOx emission is 1113 mg/m$^3$ (6% of $O_2$). In comparison with the same type boiler without using the burners of the present invention, the amount of NOx emission is 1206 mg/m$^3$ (6% of $O_2$). Therefore, a decrease of 8% of the amount of NOx emission is determined by incorporating the burner of the present invention with the boiler.

The burner of the present invention is incorporated with a 670 ton per hour B&WB-670/13.7-M type boiler made by Babcock & Wilcox Beijing Co. Ltd, as another example. The combustion condition is shown as: low-grade coal as the pulverized coal, $V_{daf}$=22.86%; $A_{ar}$=35.28%; $M_t$=7.4%; and $Q_{net,ar}$=18130 kJ/kg, wherein $V_{daf}$ is the volatile matter as dry ash free, $A_{ar}$ is ash as received, $M_t$ is the moisture as received, and $Q_{net,ar}$ is the net heating value as received. By using 6 burners of the present invention at the bottom row of burners on the boiler, the amount of NOx emission is 795 mg/m$^3$ (6% of $O_2$). In comparison with the same boiler without using the burners of the present invention, the amount of NOx emission is 961 mg/m$^3$ (6% of $O_2$). Therefore, a decrease of 17.27% of the amount of NOx emission is determined by incorporating the burner of the present invention with the boiler.

The burner of the present invention is incorporated with a 1025 ton per hour B&WB-1025/16.8-M type boiler made by Babcock & Wilcox Beijing Co. Ltd, as another example. The combustion condition is shown as: bituminous coal as the pulverized coal, $V_{daf}$=33.15%; $A_{ar}$=27.13%; $M_t$=11.8%; and $Q_{net,ar}$=17790 kJ/kg, wherein $V_{daf}$ is the volatile matter as dry ash free, $A_{ar}$ is ash as received, $M_t$ is the moisture as received, and $Q_{net,ar}$ is the net heating value as received. By using 8 burners of the present invention at the bottom row of burners on the boiler, the amount of NOx emission is 728 mg/m$^3$ (6% of $O_2$). In comparison with the same boiler without using the burners of the present invention, the amount of NOx emission is 843.55 mg/m$^3$ (6% of $O_2$). Therefore, a decrease of 13.74% of the amount of NOx emission is determined by incorporating the burner of the present invention with the boiler.

Accordingly, the operation of the burner of the present invention is shown as the following. The flow of air-coal mixture is injected into the furnace through the primary air-coal mixture duct 1, wherein the primary air-coal mixture conical outlet 11 is coupled at the outlet of the primary air-coal mixture duct 1 at a position close to the furnace. The pulverized coal separator 2 is supported within the primary air-coal mixture duct 1, wherein the diameter of the pulverized coal separator 2 is gradually reducing towards the outlet of the primary air-coal mixture duct 1. In addition, the outlet of the pulverized coal separator 2, which is the opening having a smaller diameter, is alignedly pointing towards the furnace. After the flow of air-coal mixture passes through the pulverized coal separator 2, the flow of air-coal mixture is partitioned into two portions. The inner central portion of the flow of air-coal mixture is the high-dense pulverized coal region while the outer peripheral portion of the flow of air-coal mixture is the less-dense pulverized coal region. The two portions of the flow of air-coal mixture are injected into the furnace through the primary air-coal mixture conical outlet 11. The secondary air flow passes through the secondary air wind box 3 to the inner secondary air duct 9 and the outer secondary air duct 10, wherein the secondary air flow is regulated to be swirled along the inner secondary air duct 9 and the outer secondary air duct 10 via the inner air vane 4 and the outer secondary air vane 5 respectively. It is worth to mention that the swirling direction of the secondary air flow at the inner secondary air duct 9 is the same as the swirling direction of the secondary air flow at the outer secondary air duct 10. The secondary air flow is then injected into the furnace through the inner secondary air conical outlet 12 and the outer secondary air conical outlet 13. Therefore, a moderate central recirculation zone is formed within the furnace to stabilize the combustion of the air-coal mixture.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A low NOx swirl coal combustion burner, comprising:

an air-coal mixture duct for guiding a flow of air-coal mixture therethrough in a non-swirling manner;

two or more pulverized coal separators supported within said air-coal mixture duct for partitioning said flow of air-coal mixture into a high-dense pulverized coal region at an inner central portion of said flow of air-coal mixture and a low-dense pulverized coal region at an outer peripheral portion of said flow of air-coal mixture, wherein the diameters of said pulverized coal separators are gradually and sequentially reducing towards an outlet of said air-coal mixture duct for partitioning said flow of air-coal mixture into said high-dense pulverized coal region and said low-dense pulverized coal region;

inner and outer tubular sleeves encirclingly coupled with said air-coal mixture duct to form an inner secondary air duct and an outer secondary air duct, wherein a secondary air flow is partitioned into said inner secondary air duct being guided to pass through in said inner secondary air duct in a swirling manner and said outer secondary air duct being guided to straight-forwardly pass through said outer secondary air duct in a non-swirling manner, wherein said inner secondary air duct and said outer secondary air duct are coaxially formed with respect to said air-coal mixture duct such that said inner secondary air duct, said outer secondary air duct, and said air-coal mixture duct share a common axis, wherein said inner and outer secondary air ducts are arranged for partitioning said secondary air flow into an inner secondary air flow at said inner secondary air duct as an igniter for igniting said flow of air-coal mixture and an outer secondary air flow at said outer secondary air duct as an oxygen suppler for supplying enough oxygen for complete combustion of said flow of air-coal mixture, wherein said pulverized coal separators are coaxially supported within said air-coal mixture duct along a centerline thereof;

an inner secondary air damper supported at an inlet of said inner secondary air duct, wherein an opening valve of said inner secondary air damper is selectively adjusted to adjustably control an amount of said secondary air flow being partitioned into said inner secondary air duct and said outer secondary air duct, such that said high-dense pulverized coal region and said low-dense pulverized coal region of said flow of air-coal mixture mix with said inner and outer secondary air flows to form a moderate central recirculation zone for reducing an emission of NOx during combustion;

an air-coal mixture conical outlet, an inner secondary air conical outlet, and an outer secondary air conical outlet, wherein an opening of said air-coal mixture conical outlet, with a smaller diameter, is coupled with said outlet of said air-coal mixture duct, wherein an opening of said inner secondary air conical outlet, with a smaller diameter, is coupled with an outlet of said inner secondary air duct, wherein an opening of said outer secondary air conical outlet, with a smaller diameter, is coupled with an outlet of said outer secondary air duct, wherein said conical outlets are arranged for delaying a mixing time of said flow of air-coal mixture with said inner and outer secondary air flows and to further prolong a residence time in the center recirculation zone so as to effectively reduce the formation of NOx, wherein said air-coal mixture conical outlet is extended inclinedly at an angle $\alpha$ with respect to a centerline of said air-coal mixture duct, wherein said inner secondary air conical outlet is extended inclinedly at an angle $\beta$ with respect to said centerline of said air-coal mixture duct, wherein said outer secondary air conical outlet is extended inclinedly at an angle $\gamma$ with respect to said centerline K of said air-coal mixture duct, wherein said angles $\alpha$, $\beta$, $\gamma$ are the same, wherein each of said angles $\alpha$, $\beta$, $\gamma$ has a threshold between 15° to 35°; and an inner secondary air vane supported within said inner secondary air duct, wherein said inner secondary air vane is arranged for regulating said inner secondary air flow in a swirling manner before mixing with said flow of air-coal mixture mix.

2. A low NOx swirl coal combustion burner, comprising:

an air-coal mixture duct for guiding a flow of air-coal mixture therethrough in a non-swirling manner;

two or more pulverized coal separators supported within said air-coal mixture duct for partitioning said flow of air-coal mixture into a high-dense pulverized coal region at an inner central portion of said flow of air-coal mixture and a low-dense pulverized coal region at an outer peripheral portion of said flow of air-coal mixture, wherein said pulverized coal separators are coaxially supported within said air-coal mixture duct along a centerline thereof, wherein the diameters of said pulverized coal separators are gradually and sequentially reducing towards an outlet of said air-coal mixture duct for partitioning said flow of air-coal mixture into said high-dense pulverized coal region and said low-dense pulverized coal region;

inner and outer tubular sleeves encirclingly coupled with said air-coal mixture duct to form an inner secondary air duct and an outer secondary air duct, wherein said inner and outer secondary air ducts are arranged for partitioning a secondary air flow into an inner secondary air flow at said inner secondary air duct as an igniter for igniting said flow of air-coal mixture and an outer secondary air flow at said outer secondary air duct as an oxygen suppler for supplying enough oxygen for complete combustion of said flow of air-coal mixture, wherein a swirling direction of said inner secondary air flow at said inner secondary duct is the same as a swirling direction of said outer secondary air flow at said outer secondary duct, wherein said inner secondary air duct and said outer secondary air duct are coaxially formed with respect to said air-coal mixture duct such that said inner secondary air duct, said outer secondary air duct, and said air-coal mixture duct share a common axis;

an inner secondary air damper supported at an inlet of said inner secondary air duct, wherein an opening valve of said inner secondary air damper is selectively adjusted to adjustably control an amount of said secondary air flow being partitioned into said inner secondary air duct and said outer secondary air duct, such that said high-dense pulverized coal region and said low-dense pulverized coal region of said flow of air-coal mixture mix with said inner and outer secondary air flows to form a moderate central recirculation zone for reducing an emission of NOx during combustion;

an air-coal mixture conical outlet, an inner secondary air conical outlet, and an outer secondary air conical outlet, wherein an opening of said air-coal mixture conical outlet, with a smaller diameter, is coupled with said outlet of said air-coal mixture duct, wherein an opening of said inner secondary air conical outlet, with a smaller diameter, is coupled with an outlet of said inner secondary air duct, wherein an opening of said outer secondary air conical outlet, with a smaller diameter, is coupled with an outlet of said outer secondary air duct, wherein said conical outlets are arranged for delaying a mixing time of said flow of air-coal mixture with said inner and outer secondary air flows and to further prolong a residence time in the center recirculation zone so as to effectively reduce the formation of NOx, wherein said air-coal mixture conical outlet is extended inclinedly at an angle $\alpha$ with respect to a centerline of said air-coal mixture duct, wherein said inner secondary air conical outlet is extended inclinedly at an angle $\beta$ with respect to said centerline of said air-coal mixture duct, wherein said outer secondary air conical outlet is extended inclinedly at an angle $\gamma$ with respect to said centerline K of said air-coal mixture duct, wherein said angles $\alpha$, $\beta$, $\gamma$ are the same, wherein each of said angles $\alpha$, $\beta$, $\gamma$ has a threshold between 15° to 35°;

an inner secondary air vane supported within said inner secondary air duct, wherein said inner secondary air vane is arranged for regulating said inner secondary air flow in a swirling manner before mixing with said flow of air-coal mixture mix, wherein said inner secondary air vane comprises a plurality of curved vane blades evenly and radially supported within said inner secondary air duct to regulate said inner secondary air flow in a swirling manner; and an outer secondary air vane supported at an inlet of said outer secondary air duct for regulating said outer secondary air flow in a swirling manner before mixing with said flow of air-coal mixture mix, wherein said outer secondary air vane comprises a set of flat vane blades and a regulator to selectively adjust a regulating angle of each of said flat vane blades, so as to regulate a swirl intensity of said outer secondary air flow.

* * * * *